United States Patent [19]

Bourges

[11] 3,945,300

[45] Mar. 23, 1976

[54] TELESCOPIC JACK

[75] Inventor: Bernard M. Bourges, Le Plessis-Belleville, France

[73] Assignee: Societe Anonyme: Poclain, Le Plessis-Belleville, France

[22] Filed: Dec. 3, 1974

[21] Appl. No.: 529,213

[30] Foreign Application Priority Data

Dec. 3, 1973 France ..... 73.43049

[52] U.S. Cl. ..... 91/173; 91/189 R; 91/411 R; 92/75; 92/52; 92/152

[51] Int. Cl.[2] ..... F01B 7/20

[58] Field of Search ..... 91/173, 189, 207, 411 R; 92/50, 51, 52, 53, 69, 75, 65, 61, 152

[56] References Cited

UNITED STATES PATENTS

| | | | |
|---|---|---|---|
| 1,442,968 | 1/1923 | Paul | 92/51 X |
| 3,240,008 | 3/1966 | McMullen | 91/189 X |
| 3,426,649 | 2/1969 | Koppers | 91/189 X |
| 3,610,100 | 10/1971 | Hoffman | 91/173 X |
| 3,672,257 | 6/1972 | Yunoki et al. | 91/189 X |

FOREIGN PATENTS OR APPLICATIONS

| | | | |
|---|---|---|---|
| 43,323 | 12/1971 | Japan | 92/75 |
| 455,964 | 3/1950 | Italy | 91/207 |

*Primary Examiner*—Carlton R. Croyle
*Assistant Examiner*—Edward Look
*Attorney, Agent, or Firm*—Lewis H. Eslinger; Alvin Sinderbrand

[57] ABSTRACT

This invention relates to a telescopic jack constituted by a main cylinder, a first piston sliding in said main cylinder, a first piston rod fast with the first piston which passes in tight manner through a first bottom of the cylinder, a second piston which may be disposed in a bore of the first rod and is mounted to slide with respect to the first piston, and by a second piston rod which is fast with the second piston.

The second piston rod passes through the second bottom of the cylinder whilst the piston is separable from the rod.

One application of the invention is the production of an inexpensive telescopic jack.

3 Claims, 6 Drawing Figures

TELESCOPIC JACK

The present invention relates to a telescopic jack.

Various types of telescopic jacks are already known, of which the characteristic resides in that, save for the first piston mounted to slide in the main outer cylinder, each piston is mounted to slide in the rod of the preceding piston, the rods, fast with the various pistons, all extending on the same side with respect to the main cylinder.

It is generally expensive to produce such jacks, since numerous machining operations are to be effected on almost all the parts. Furthermore, it is not possible to impose a simple sequence of extension of the various piston rods.

It is to remedy these drawbacks that the invention proposes a novel type of telescopic jack.

This fluid-controlled telescopic jack is constituted by:

- a main cylinder defined by two bottoms,
- a first piston mounted to slide in said main cylinder,
- a first piston rod, fast with the first piston, which passes in tight manner through a first of said two bottoms, in such a manner that its end is disposed outside the main cylinder and in which a bore is made,
- a second piston, which may be disposed in said bore and is mounted to slide with respect to said first piston and first piston rod, and
- a second piston rod, fast with the second piston, whose end is also disposed outside the main cylinder, and which passes in tight-manner through the second of said two bottoms, its end being disposed on the side opposite that of the first piston rod with respect to the main cylinder.

The section of the opening of the bore of the first piston rod through which said bore opens out into the main cylinder is at least equal to the section of the second piston, whilst said first piston rod and said second piston are then separable and are effectively separated when the first piston is in abutment on the first bottom and when the second piston is itself in abutment on the second bottom.

The first piston and the first piston rod preferably define in the main cylinder, on the one hand, with the first bottom, a first chamber and, on the other hand, with the second bottom, a second chamber. Similarly, when the jack is in retracted position, the second piston defines, on the one hand, with the bottom of said bore, a third chamber, and on the other hand, on the side opposite this third chamber, a fourth chamber. Finally, three conduits are made in the first piston rod and possibly in the first piston and connect the outer end of this first rod, viz. the first conduit to the first chamber, the second conduit to the second chamber and the third conduit to the third chamber.

It is advantageous for a connecting conduit, made in the first piston, to connect the first and second chambers. A calibrated valve is then disposed in said connecting conduit, is provided with a return member whose effect tends to maintain this connecting conduit closed, and is coupled to a proximity detector controlling its opening when the first piston is disposed near the second bottom.

A feed conduit connects the part of said connecting conduit between the second chamber and the calibrated valve to the fourth chamber, whilst a non-return valve is disposed in this feed conduit and allows passage of the fluid from the connecting conduit towards the fourth chamber.

Finally, it is also advantageous for a cylindrical projection to be fast with the inner face of the second bottom, of diameter equal to that of the bore and to be contained in said bore, when the first piston is in abutment on this second bottom.

The invention will be more readily understood on reading the following description with reference to the accompanying drawings, in which.

The elements of the jack shown in FIGS. 1 to 5 are referenced by the same number in these five Figures, followed by the letter *a*, *b*, *c*, *d* or *e*, respectively.

Figure 1:
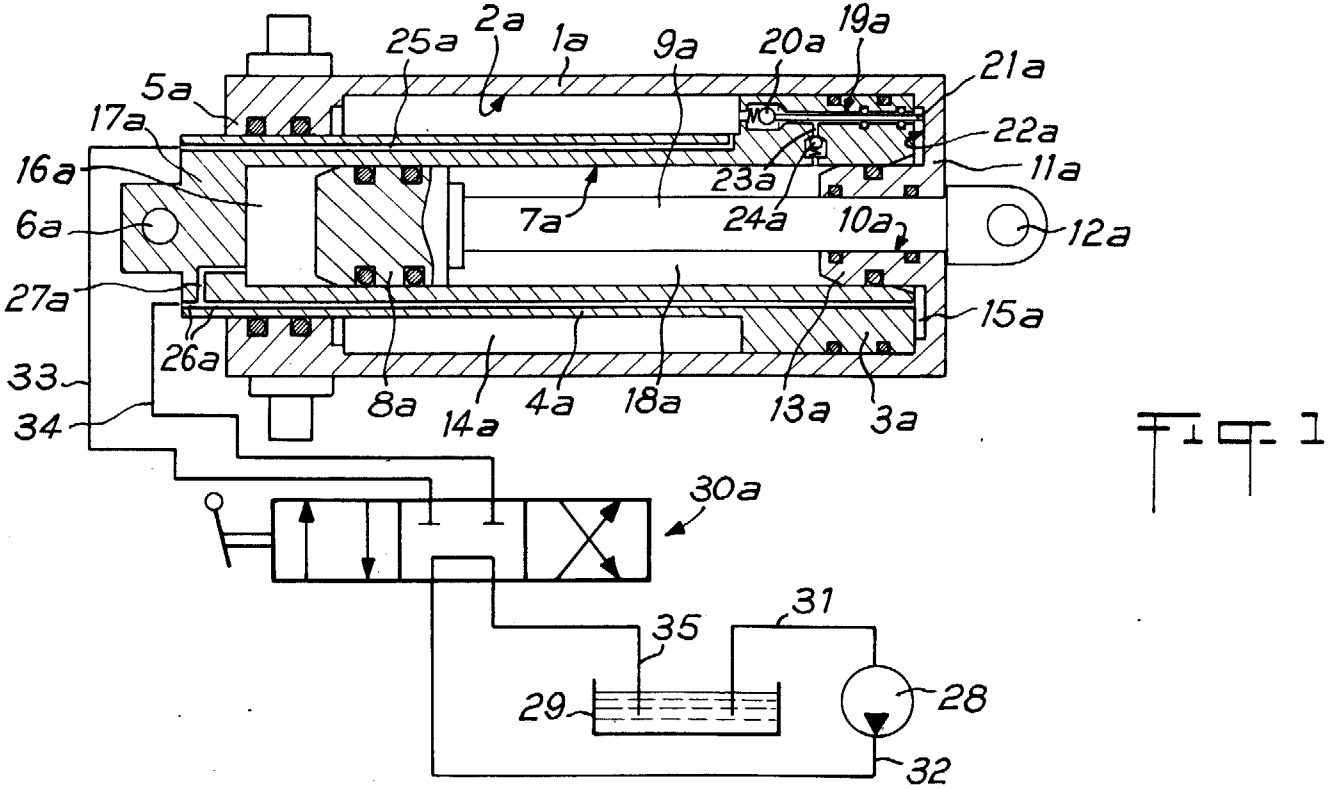
FIGS. 1 to 5 are axial sections through the same jack, in accordance with the invention, in five distinct configurations.

In FIG. 1, the jack is entirely retracted. It is constituted by:

- a body 1*a*, in which a cylinder 2*a* is made,
- a first piston 3*a* mounted to slide in the cylinder 2*a*,
- a first piston rod 4*a* which is fast with the piston 3*a*, leaves the body 1*a* through a first bottom 5*a* of the cylinder and the end 6*a* of which is outside the body 1*a*,
- a bore 7*a* coaxial to the rod 4*a* and piston 3*a*,
- a second piston 8*a* which is introduced into the bore 7*a*,
- a second piston rod 9*a* which is fast with the second piston 8*a*, mounted to slide in a bearing 10*a* of the body 1*a* and which emerges from the body 1*a*, passing through the second bottom 11*a* of the cylinder, its end 12*a* being outside said body 1*a*,
- and a projection 13*a* which is fast with the bottom 11*a*, is fixed to its inner face and is introduced into the bore 7*a*.

The first piston 3*a* defines in cylinder 2*a* a first chamber 14*a* (in cooperation with the first bottom 5*a*) and a second chamber 15*a* (in cooperation with the second bottom 11*a*). Similarly, the second piston 8*a* defines in the bore 7*a* a third chamber 16*a* (in cooperation with the bottom 17*a* of said bore) and a fourth chamber 18*a*.

It is noted that a connecting conduit 19*a* is made in the first piston 3*a* and connects the first chamber 14*a* to the second chamber. A calibrated ball valve 20*a* is disposed in this connecting conduit 19*a* and is coupled to a rod 21*a*. The end of this rod 21*a* is, in the present case, in abutment on internal face 22*a* of the bottom 11*a*, this causing the ball valve 20*a* to open. A feed conduit 23*a* connects the conduit 19*a* to the fourth chamber 18*a*, whilst a non-return valve 24*a*, disposed in this feed conduit 23*a*, allows passage of the fluid only from the connecting conduit 19*a* towards the fourth chamber 18*a*.

It will also be noted that a first conduit 25*a* permanently connects the outer end of the rod 4*a* to the first chamber 14*a* (opening near the first piston 3*a*), that a second conduit 26*a* permanently connects the outer end of said rod 4*a* to the second chamber 15*a* and that finally a third conduit 27*a* permanently connects the second conduit 26*a* to the third chamber 16*a*. All three of these conduits 25*a*, 26*a* and 27*a* are made in the first piston rod 4*a* and first piston 3*a* only.

Outside the jack, there is an elementary feed circuit which comprises:

- a pump 28, a fluid tank 29, and a three-way distributor 30*a*.

The pump 28 is connected to the tank 29 by its suction conduit 31 and to the distributor 30*a* by its delivery conduit 32. The first conduit 25*a* and the second conduit 26*a* of the jack are connected to the distributor 30*a* by secondary conduits 33 and 34. Finally, the distributor 30*a* is connected to the tank 29 by a discharge conduit 35.

The three positions of the distributor 30*a* corresponds as follows:

- the first position, to the communication of conduits 32 and 34, and of conduits 33 and 35;
- the second position, in which the distribution 30*a* is shown, to the communication of conduits 32 and 35, and to the closures, at distributor 30*a*, of conduits 33 and 34;
- and the third position, to the communications of conduits 32 and 33, and of conduits 34 and 35.

Figure 2:
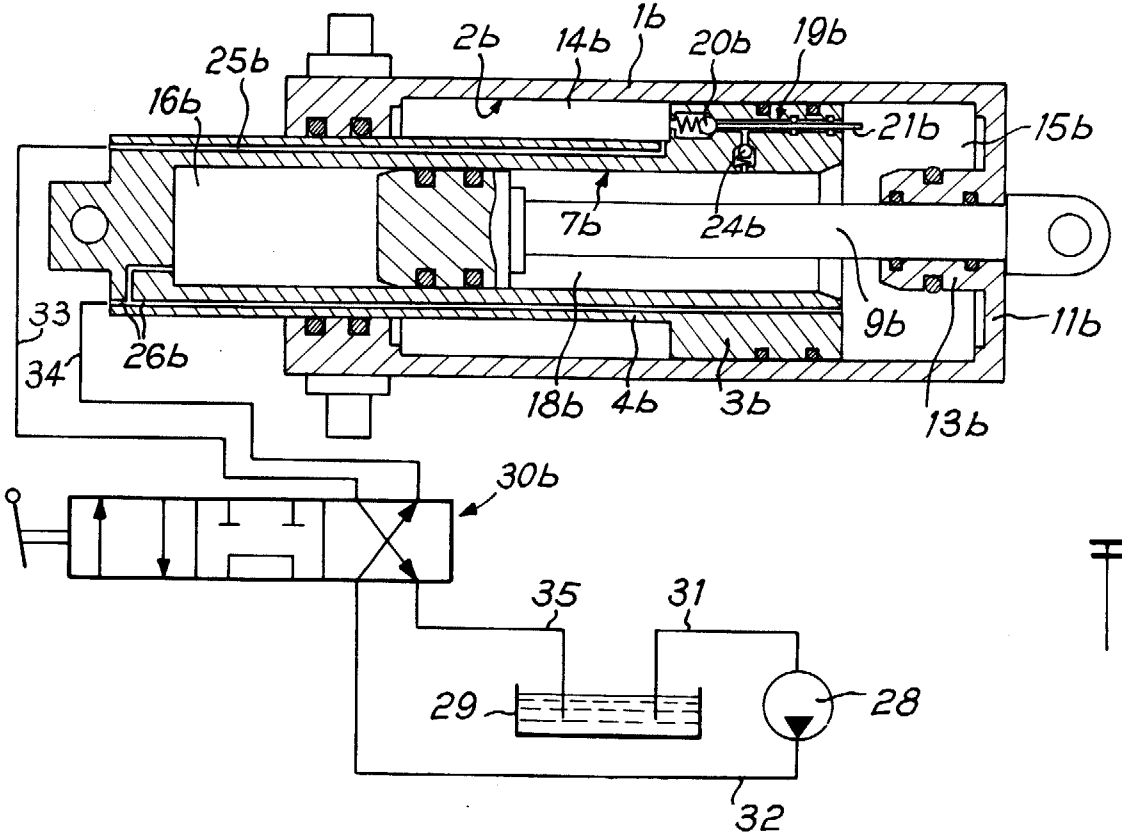

The lay-out of FIG. 2 corresponds to the first phase of extension of the jack from the lay-out of FIG. 1. The distributor has come to 30*b*, in its first position. The second chamber, fed with pressurised fluid by conduits 32, 34 and 26*b*, has come to 15*b*. The first piston 3*b* is now sufficiently distant from the bottom 11*b* for the rod 21*b* no longer to be in abutment thereon, and consequently, the calibrated ball valve 20*b* is again in position where the connecting conduit 19*b* is closed. It is noted that the piston 3*b* has made a partial stroke in the cylinder 2*b*, which has caused the projection 13*b* to leave the bore 7*b* completely. Furthermore, the second piston rod 9*b* has remained immobile with respect to the body 1*b*. This disposition results in the second chamber 15*b* and fourth chamber 18*b* communicating. It should be noted, by way of indication, that the initial fluid feed to the second chamber 15*a*, then 15*b*, and third chamber 16*a*, then 16*b*, causes the extension of the first piston rod 4*a*, then 4*b* out of the body of the jack, only in consideration of the relationships selected, in the present case, between the sections of the various faces of the first and second pistons. The first chamber 14*b*, being isolated from the second chamber 15*b* by the ball valve 20*b* and from the fourth chamber 18*b* by the non-return valve 24*b*, the fluid that it contains may return freely to the tank 29 via conduits 25*b*, 33 and 35.

Figure 3:
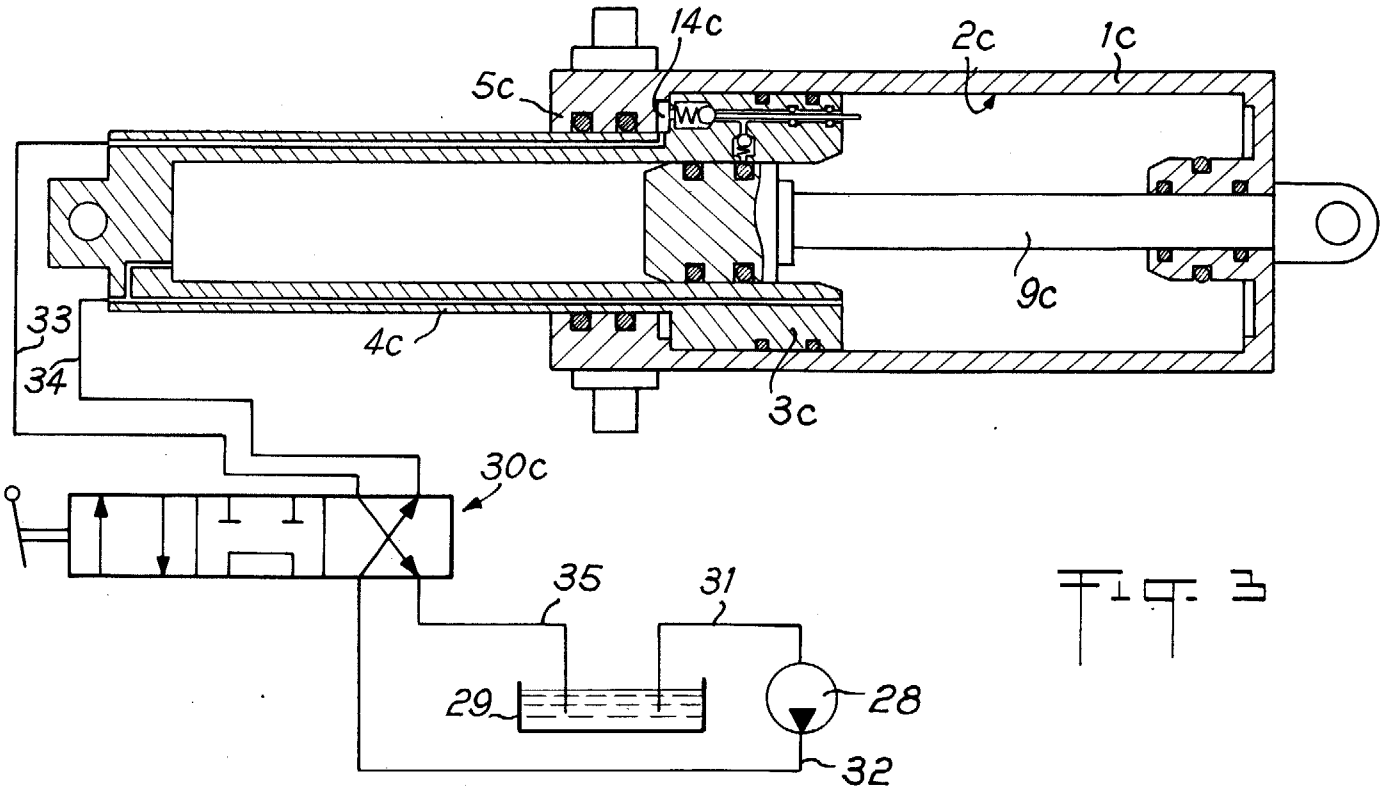

The jack continues to extend, therefore, by the first piston rod 4*c* completely leaving the body 1*c* (FIG. 3), the distributor 30*c* still being in its first position. The first piston 3*c* is now in abutment on the inner face of the first bottom 5*c* of the cylinder 2*c*, and the volume of the first chamber 14*c* is now very small, almost zero. The second piston rod 9*c* has still not moved with respect to the body 1*c*.

Figure 4:
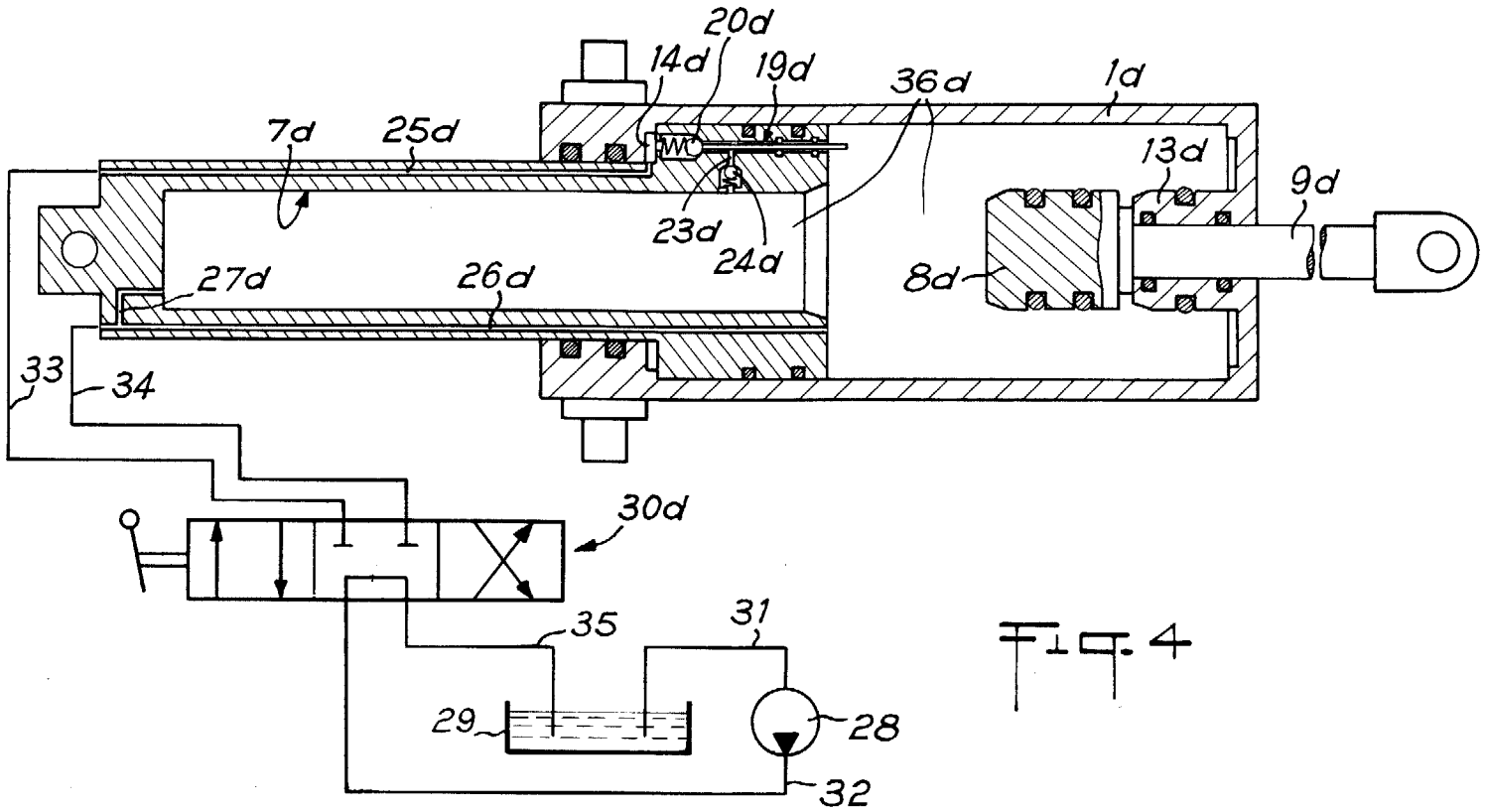

The jack then continues to extend by this second piston rod 9*d* completely leaving the body 1*d* until the second piston 8*d* comes into abutment on the projection 13*d* (FIG. 4). The first chamber 14*d* has a volume equal to that of the chamber 14*c*, thus a very small one. On the other hand, the second piston 8*d* has come entirely out of the bore 7*d*, this causing the other three chambers, the second, third and fourth ones, to combine to form a large single chamber 36*d*. When the jack has finished its extension, the distributor 30*d* has, furthermore, been replaced in its second position. It is to be noted that the calibrated valve 20*d* and the nonreturn valve 24*d* remain closed and consequently that the connecting and feed conduits 19*d* and 23*d* respectively remain closed. On the contrary, the conduit 25*d* still opens out into the first chamber 14*d* in the same way as conduits 26*d* and 27*d* open out into the large chamber 36*d*.

Figure 5:
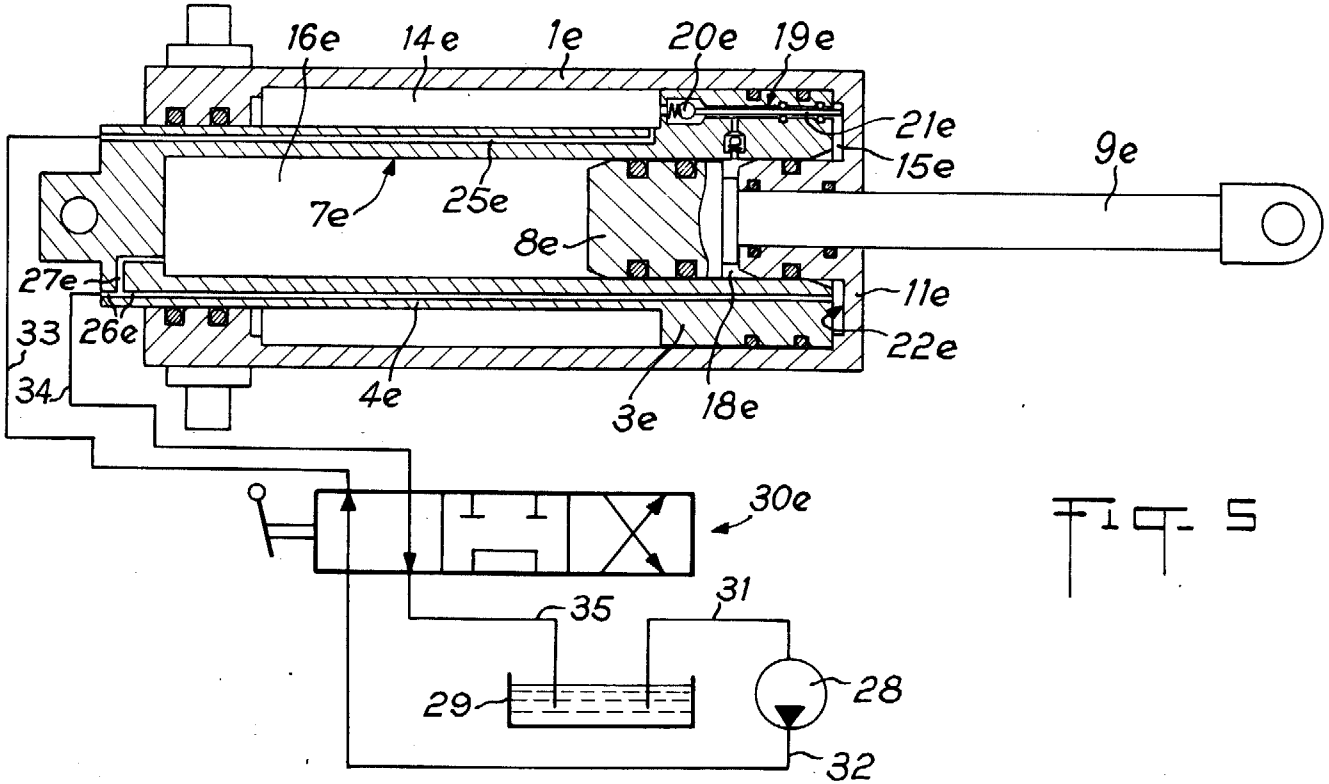

Starting from its configuration where it is completely extended (FIG. 4), the jack retracts, passing through the lay-out of FIG. 5, until it returns to the lay-out of FIG. 1.

In FIG. 5, the distributor 30*e* is maintained in its third position. Initially, the large chamber 36*d*, then subsequently the second chamber 15*e* and third chamber 16*e* are communicated with tank 29, via conduits 26*e* and 27*e* and 34 and 35. On the contrary, the first chamber 14*e* is placed in communication with the delivery of pump 28 via conduits 25*e*, 33 and 32. In this way, the pressurised fluid acts on the section of the first piston 3*e*, which defines the chamber 14*e* and causes the first piston rod 4*e* to retract inside the body l*e*, until the piston 3*e* abuts on the face 22*e* of the bottom 11*e*. When the rod 4*e* has finished retracting, the rod 21*e* is also in abutment on the face 22*e* and opens the calibrated ball valve 20*e* and the connecting conduit 19*e*. The pressurised fluid pushes the non-return valve 24*e* which opens and, from the first chamber 14*e*, is directed towards the fourth chamber 18*e*. The effect of this fluid on the face of the second piston 8*e*, which defines said fourth chamber 18*e*, is to bring about the return of the second piston rod 9*e* inside the body 1*e* (and the bore 7*e*). The lay-out of FIG. 5 therefore changes into the initial, entirely retracted lay-out of FIG. 1.

The extension or retraction of the jack which has just been described corresponds to a relative order of extension or retraction of the various elements which depends essentially on the distribution of the fluid in the second chamber 15*a* and third chamber 16*a* from the single conduit 34. This distribution depends in its turn on the relationships of the sections of the faces of the two pistons. If it is desired not to follow this imposed order, a flow distributor known per se may be used which maintains a given relationship between the flows.

Figure 6:
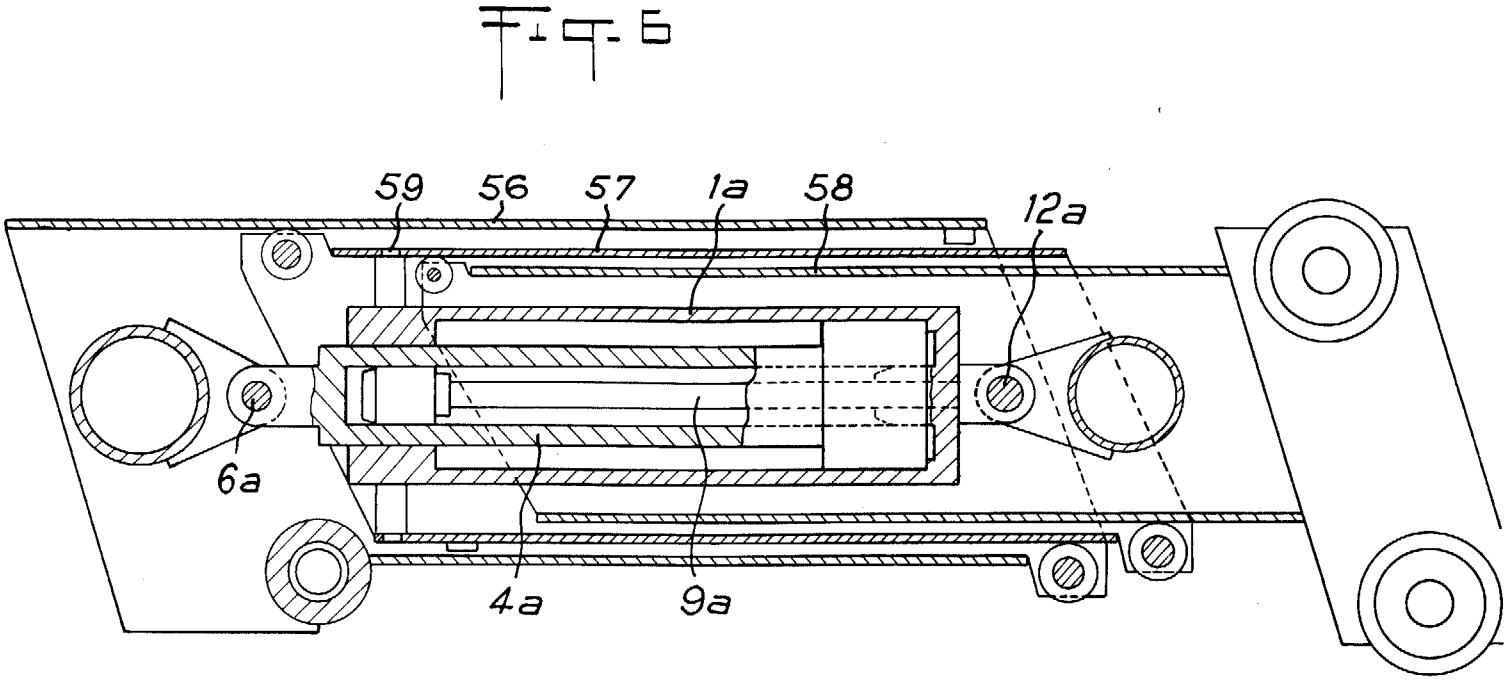
FIG. 6 shows, in axial section, an assembly applying the jack of FIGS. 1 to 5.

Finally, FIG. 6 shows an assembly applying the jack that has already been described, to the manoeuvring of a telescopic jib having three sections 56, 57 and 58. The end 6*a* of the first piston rod 4*a* is articulated to the rear of the main outside section 56, the body 1*a* is articulated at 59 to the rear of the intermediate section 57 and the end 12*a* of the second rod of the piston 9*a* is articulated to the front of the inside section 58.

The advantages of the above-mentioned piston will now be described, as follows:

Structural advantages will firstly be discussed. In fact, it will have been noted that the conduits 25*a*, 26*a* and 27*a* are made in one piece, the first piston rod 4*a* (and the first piston 3*a* with which it is fast). It is already obvious that, from the standpoint of the manipulation of workpieces for machining, this disposition is particularly favourable, since it limits the said machining operations to one workpiece only. From the standpoint of the dimensions of the jack, it is known that the necessity of making a conduit in a piston rod leads to having to increase the thickness of the material constituting this piece. There again, the jack which has been described is advantageous, since the increase of the thickness will concern only one piston rod 4*a*, and not several piston rods as is the case for prior known jacks.

As the various phases of the extension, then retraction, have been shown and explained with reference to FIGS. 1 to 5, it is unnecessary to come back to this point, except to ascertain that the jack described is indeed a telescopic jack.

Similarly, its application to the control of the telescoping of the sections of a telescopic jib is sufficiently shown in FIG. 6, this rendering any further explanation unnecessary.

What is claimed is:

1. A fluid controlled telescopic jack comprising a main cylinder having first and second opposite end portions, a first piston rod located in said main cylinder and extending through the first end portion thereof in fluid tight relation for sliding movement between extended and retracted positions, said first piston rod having a hollow bore formed therein opening towards the second end portion of said main cylinder, a first piston surrounding a portion of said first piston rod and slidable in said main cylinder housing in liquid tight relation with the interior walls thereof, said first piston being located on said first piston rod, when the first piston rod is in its retracted position, adjacent and slightly spaced from said second end portion of the main cylinder to define a first chamber between the first piston and the first end portion of the main cylinder and a second chamber between the first piston and the second end portion of the main cylinder; a second piston located in the bore of the first piston rod and slidable therein in fluid tight relation; a second piston rod secured to said second piston and extending therefrom through the second end portion of the main cylinder in fluid tight relation for movement between extended and retracted positions, said second piston defining, in the retracted position of said piston rods, a third chamber in the bore of said first piston rod and a fourth chamber between the second piston and the second end portion of said main cylinder, whereby said first piston rod and said second piston are separable and are separated when the first piston rod is extended to move the first piston adjacent said first end portion of the main cylinder and the second piston rod is extended and the second piston is adjacent the second end portion of the main cylinder, said first piston rod having three fluid flow conduits formed therein and adapted to be connected to a source of fluid under pressure, said conduits including a first conduit connecting said source of fluid to said first chamber, a second conduit connecting said source of fluid to said second chamber and a third conduit connecting said second conduit to said third chamber whereby said second and third chambers are simultaneously supplied with fluid to extend said first piston rod before said second piston rod.

2. The jack as defined in claim 1 wherein said first piston has a connecting conduit formed therein providing communication between said first and second chambers, resiliently biased calibrated check valve means located in said connecting conduit for normally closing the connecting conduit to fluid flow; proximity detector means in said connecting conduit for opening the check valve means when said first piston is adjacent the second end portion of the main cylinder; a feed conduit formed in said first piston connecting said connecting conduit between the second chamber and the calibrated check valve means to the fourth chamber; and non-return valve means located in said feed conduit for normally closing the feed conduit and allowing fluid flow from the connecting conduit to the fourth chamber when said check valve means is opened whereby during retraction of the jack, the first piston rod is first fully retracted to open said check valve means and then fluid flows from the first conduit into the first chamber through the check valve means and non-return valve means to the fourth chamber to retract the second piston rod.

3. A jack as defined in claim 2 including a projection located on the inner face of the second end portion of the main housing and being dimensioned to be received in liquid tight relation in the bore formed in the first piston rod when the first piston is adjacent said second end portion to separate said fourth chamber from said second chamber and aid in the sequential extension and retraction of said piston rods.

* * * * *